US005436403A

United States Patent [19]

Usa

[11] Patent Number: 5,436,403

[45] Date of Patent: Jul. 25, 1995

[54] AUTOMATIC PERFORMANCE APPARATUS CAPABLE OF PERFORMING BASED ON STORED DATA

[75] Inventor: Satoshi Usa, Hamamatsu, Japan

[73] Assignee: Yamaha Corporation, Japan

[21] Appl. No.: 163,943

[22] Filed: Dec. 8, 1993

[30] Foreign Application Priority Data

Dec. 9, 1992 [JP] Japan ..... 4-329714

[51] Int. Cl.[6] ..... G10H 1/053; G10H 1/06; G10H 1/26; G10H 1/46

[52] U.S. Cl. ..... 84/609; 84/622; 84/626; 84/633

[58] Field of Search ..... 84/609-614, 84/626-643, 622-625

[56] References Cited

U.S. PATENT DOCUMENTS

| | | | |
|---|---|---|---|
| 4,020,729 | 5/1977 | Guillemette | 84/642 |
| 4,984,276 | 1/1991 | Smith . | |
| 5,095,799 | 3/1992 | Wallace et al. | 84/626 X |
| 5,229,533 | 7/1993 | Sakurai | 84/633 X |
| 5,270,477 | 12/1993 | Kawashima | 84/626 X |
| 5,283,388 | 2/1994 | Shimada | 84/626 X |
| 5,292,996 | 3/1994 | Ogawa | 84/626 |

FOREIGN PATENT DOCUMENTS

WO80/02886 12/1980 Japan .

*Primary Examiner*—Stanley J. Witkowski
*Attorney, Agent, or Firm*—Graham & James

[57] ABSTRACT

An automatic performance apparatus has a memory, a reading out circuit, a parameter creating circuit, and a tone generating circuit. Initially, basic performance data corresponding to the basic performance of a musical piece and musical expression data corresponding to musical expression to be imparted to the basic performance are stored in the memory according to the progress of the musical piece. Next, when the basic performance data and musical expression data are read out from the memory by the reading out circuit in due order, the parameter including musical expression is created based on the read out basic performance data and musical expression data in the parameter creating circuit. Accordingly, this parameter is supplied to the tone generating circuit and a musical tone signal to which musical expression is imparted is formed in the tone generating circuit.

14 Claims, 8 Drawing Sheets

AUTOMATIC PERFORMANCE APPARATUS CAPABLE OF PERFORMING BASED ON STORED DATA

BACKGROUND OF THE INVENTION

1. Field of the Invention

The present invention relates to automatic performance apparatuses, and more particularly, to automatic performance apparatuses for storing data corresponding to the operation of a keyboard and the like, and carrying out automatic performance based on the stored data.

2. Prior Art

Due to recent technological improvements, tone generating devices employed in electronic musical instruments have become available which are capable of synthesizing a wide variety of musical tones. For example, physical model tone generating devices are conventionally known which synthesize tones which effectively simulate the sound of a conventional non-electronic musical instrument by simulating the sound production mechanism of the target non-electronic musical instrument. Such physical model tone generating devices are suitable for synthesizing the musical tone of rubbed stringed musical instruments or wind musical instruments because they have a high power of expression. Examples of the above-mentioned type of tone generation device have been disclosed in U.S. Pat. No. 4,984,276.

An example of a conventional physical model tone generating device suitable for simulating the sound production mechanism of wind musical instrument is shown in the block diagram of FIG. 10. In this figure, a non-linear element 1 simulates the non-linear characteristics of a reed which is a sound producing element of the wind musical instrument, to which embouchure data $PAR_1$ is supplied from a control circuit (not shown), and wherein the non-linear characteristics are controlled.

Delays 2 and 3 comprise, for example, multi-stage shift resisters, respectively, which simulate the transmission delay of an air pressure wave in the tube of the wind musical instrument, and wherein the delay time (or the delay length) of the delays 2 and 3, which basically signify the tube length of the wind musical instrument, is controlled by delay data $D_1$ and $D_2$ from the control circuit. An adder 4 simulates the pressure calculation carried out in the reed and to which blowing pressure data VOL is supplied from the control circuit.

A junction 5 simulates the scattering phenomenon in the generating of the air pressure wave in the position to which tubes having different diameters are connected. A 4-multiplier-type lattice is used for this junction 5. The 4-multiplier-type lattice comprises multipliers $6_1$ through $6_4$, respectively having multiplying coefficients $K_1$ through $K_4$ corresponding to the signal scattering characteristics in the wind musical instrument, an adder $7_1$ adding the output data from the multipliers $6_1$ and $6_4$, and an adder $7_2$ adding the output data from the multipliers $6_2$ and $6_3$. In the junction 5, the multiplying coefficients $K_1$ through $K_4$ of the multipliers $6_1$ through $6_4$ are controlled by the multiplying data $PAR_{31}$ through $PAR_{34}$ from the control circuit.

A multiplier 8 simulates radiating loss and the like in the case where the pressure wave is reflected at an end of the wind musical instrument, and the multiplying coefficient (end feedback coefficient) of the multiplier 8 is controlled by the multiplying data $PAR_2$ from the control circuit. A filter 9 simulates the loss inside the tube and the shape of tube of the wind musical instrument, and the coefficient of the filter 9 is controlled by the coefficient data PAR4 from the control circuit.

With the conventional tone generating device described above, when the embouchure data $PAR_1$ and the blowing pressure data VOL from the control circuit are supplied to each portion of the physical model tone generating device shown in FIG. 10, the delaying procedure, multiplying procedure or attenuating procedure and the like are imparted to the data from the nonlinear element 1 as it circulates in the closed loop circuit comprising the non-linear element 1, the delays 2 and 3, the adder 4, the junction 5, the multiplier 8 and the filter 9, namely, the loop comprising: delay 2→junction 5→delay 3→multiplier 8→filter 9→junction 5→adder 4→non-linear element 1, and thereby becomes data peculiar to the wind musical instrument. Then, for example, the output data from the delay 3 is delivered as a musical tone data.

In an electronic musical instrument having the above conventional physical model tone generating device, it may be imaged so that various data to be supplied to each part of the physical model tone generating device are automatically supplied from the control circuit and thereby automatic performance is carried out. In this case, each of all the parameters varying moment by moment may be pre-stored in an automatic performance data memory provided in the electronic musical instrument, then each of the parameters may be read out in due order from the automatic performance data memory according to the progress of the musical piece, and may be supplied to the physical model tone generating device.

However, in this case, there are the following problems:

(1) generation of each of the parameters to be stored in the automatic performance data memory;

(2) storage of the generated parameters in the automatic performance data memory; and (3) editing of the parameters stored in the automatic performance data memory.

In the case of the physical model tone generating device, because the relation between each of the parameters and the generation of musical tone is complex, the relation is not easily intuitively understood. For example, in the above-mentioned physical model tone generating device simulating the sound production mechanism of the wind musical instrument, when the blowing pressure data VOL is changed, the tone volume, tone color and pitch, and the like are also changed.

Furthermore, since the physical model tone generating device works in the same manner as the non-electronic musical instrument, for example, in the case of an electronic musical instrument having the physical model tone generating device simulating the sound production mechanism of the wind musical instrument, each of the parameters such as a blowing pressure data VOL and an embouchure data PAR1 can be generated and supplied to the physical model tone generating device by actually performing the electronic musical instrument by an operator. Therefore, each of the parameters can be generated relatively easily, and the operator can make the electronic musical instrument carry out an automatic performance which is close to his specifications by storing the thus generated parameters in the memory. Examples of the above-mentioned technique have been disclosed, for example, in International Laid-open Publication No. W080/02886.

However, in this case, since the operator must nearly perfectly master the performance of the wind musical instrument, it is very difficult for a performer of a general keyboard-type electronic musical instrument to generate each of the parameters of the physical model tone generating device using the above-mentioned method. This problem also occurs in the case of generating each of the parameters of the physical model tone generating device simulating the sound production mechanism of the rubbed stringed musical instrument.

Moreover, even if, for example, a operator who masters the performance of the wind musical instrument can once store each of the parameters in the automatic performance data memory, in the case of editing each of the parameter, it is difficult for the operator to understand how to vary each of the parameters so as to be able to make the electronic musical instrument carry out the automatic performance according to his specifications. Accordingly, there is the problem that all of the parameters must be restored in the automatic performance data memory from the beginning to make the electronic musical instrument carry out the automatic performance according to the performer's specifications. The above-mentioned problem can be applied to FM (Frequency Modulation) tone generating devices or PCM (Pulse Code Modulation) tone generating devices and the like in similar ways, as well as to physical model tone generating devices.

SUMMARY OF THE INVENTION

In consideration of the above-mentioned problems, it is an object of the present invention to provide an automatic performance apparatus which is capable of easily generating parameters provided to a tone generating device, in which the relation between each of the parameters and the generation of a musical tone is complex, such as in a physical model tone generating device, by an automatic performance.

To satisfy this object, the present invention provides an automatic performance apparatus comprising: storage means for storing basic performance data corresponding to the basic performance of a musical piece and musical expression data corresponding to musical expression, which is imparted to said basic performance, according to the progress of said musical piece; reading out means for reading out said basic performance data and said musical expression data from said storage means in due order; parameter creating means for creating parameters including said musical expression based on the read out basic performance data and musical expression data; and musical tone forming means for receiving said created parameters and forming musical tone signals, to which said musical expression is imparted, based on the received parameters.

According to such a structure, the basic performance data and musical expression data are initially stored in the storage means according to the progress of the musical piece. The basic performance data and the musical expression data is read out from the storage means in due order, so that the parameter including the musical expression is created based on the read out basic performance data and musical expression data. Then, the musical tone forming means receives the created parameters and forms musical tone signals, to which the musical expression is imparted, based on the received parameters.

Moreover, the present invention provides an automatic performance apparatus comprising: storage means having a plurality of storage tracks; a plurality of manually operable members each of which generates operation information in response to the operation thereof by a player and corresponds to one of said plurality of storage tracks; writing means for writing the generated operation information in the corresponding one of said plurality of storage tracks; reading out means for reading out said operation information from each of said plurality of storage tracks; and creating means for creating at least one musical tone control parameter based on the read out operation information from each of said plurality of storage tracks, wherein an automatic performance is carried out based on said created one musical tone control parameter.

According to such a structure, when the plurality of manually operable members are operated by the player, the operation information is generated in each of the manually operable members in response to the operation thereof by the player, and the generated operation information is in the corresponding one of the plurality of storage tracks by the writing means. Next, when the operation information is read out from each of the plurality of storage tracks, at least one musical tone control parameter is created in the creating means based on the read out operation information from each of the plurality of storage tracks. Therefore, the automatic performance is carried out based on the created one musical tone control parameter by the creating means.

According to the present invention, a positive effect is that the parameters provided to the tone generating device, in which the relation between each of the parameters and the generation of a musical tone is complex, such as a physical model tone generating device, can be easily generated by an automatic performance without the same performance technique as non-electronic musical instruments. Furthermore, because an operator can sensitively edit, in the case of editing the basic performance data and musical expression data once stored in the storage means, a positive effect is that an edit operation can be easily carried out.

DETAILED DESCRIPTION OF THE PREFERRED EMBODIMENTS

Figure 1:
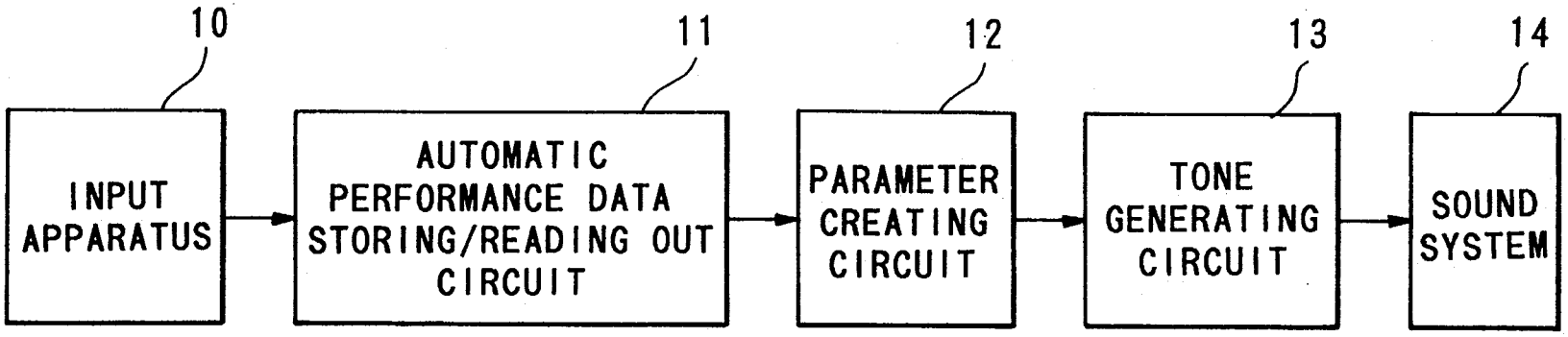
FIG. 1 shows a block diagram of the electrical structure of an automatic performance apparatus based on the preferred embodiment of the present invention.

Hereinafter, an explanation of the preferred embodiment of the present invention is given with reference to the figures. FIG. 1 shows a block diagram of the electrical structure of an automatic performance apparatus based on the preferred embodiment of the present invention. In this figure, an input apparatus 10 is provided, which comprises a manually operable performance member such as a keyboard and various manually operable members such as a wheel, a pedal, a joystick, or a foot volume. An automatic performance data storing/reading out circuit 11 stores automatic performance data comprising basic performance data corresponding to a basic performance of a musical piece and musical expression data corresponding to musical expression imparted to the basic performance supplied thereto, using the input apparatus 10 according to the progress of the musical piece in an automatic performance data memory therein, and reads out the stored basic performance data and musical expression data from the automatic performance data memory in due order.

Furthermore, a parameter creating circuit 12 and a tone generating circuit 13 are provided. The tone generating circuit 13 comprises, for example, the physical model tone generating device shown in FIG. 10. The parameter creating circuit 12 creates parameters such as embouchure data $PAR_1$, blowing pressure data VOL and the like driving the tone generating circuit 13 based on the read out basic performance data and musical expression data by the automatic performance data storing/reading out circuit 11. Therefore, the tone generating circuit 13 forms musical tone data and delivers it. A sound system 14 comprises a D/A converter converting the musical tone data from the tone generating circuit 13 into an analog musical signal, an amplifier amplifying the musical tone signal, and speakers converting the output signal from the amplifier into a musical tone.

Figure 2:
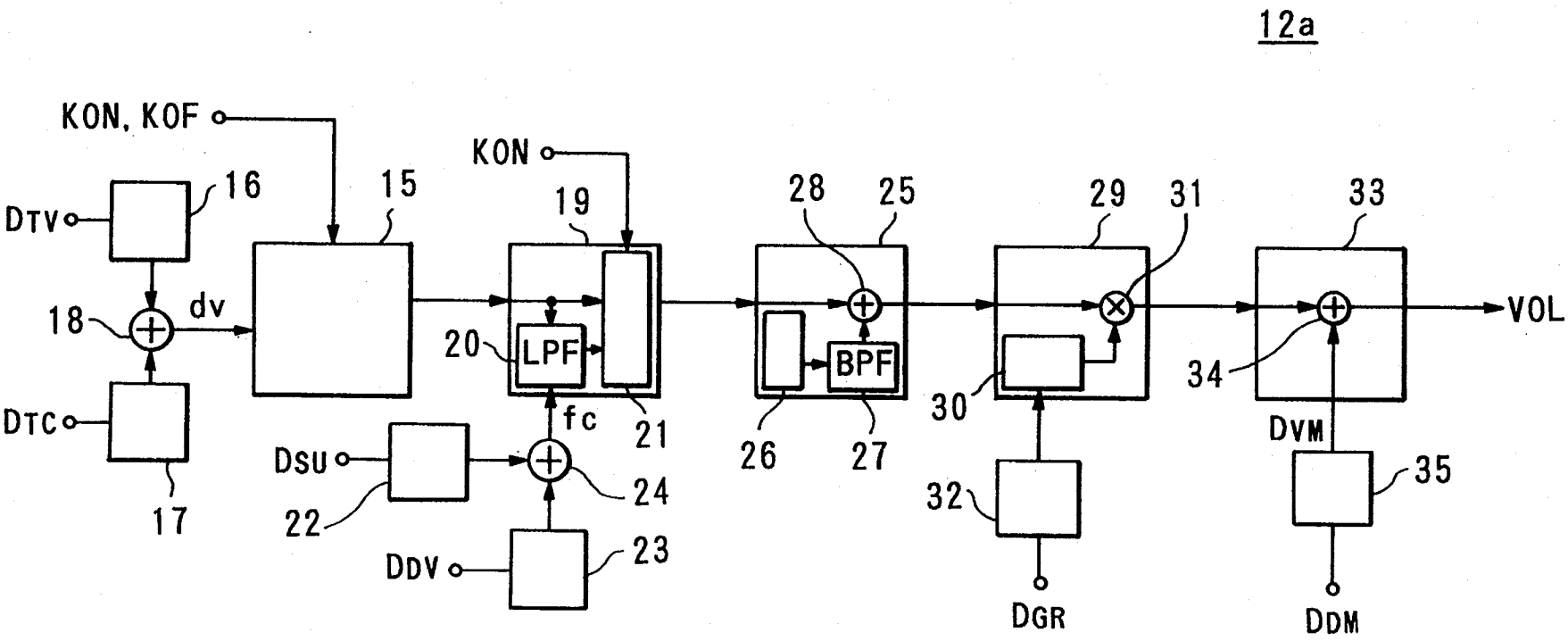
FIG. 2 shows a block diagram of the electrical structure of a blowing pressure data creating portion 12*a*.
Figure 3:
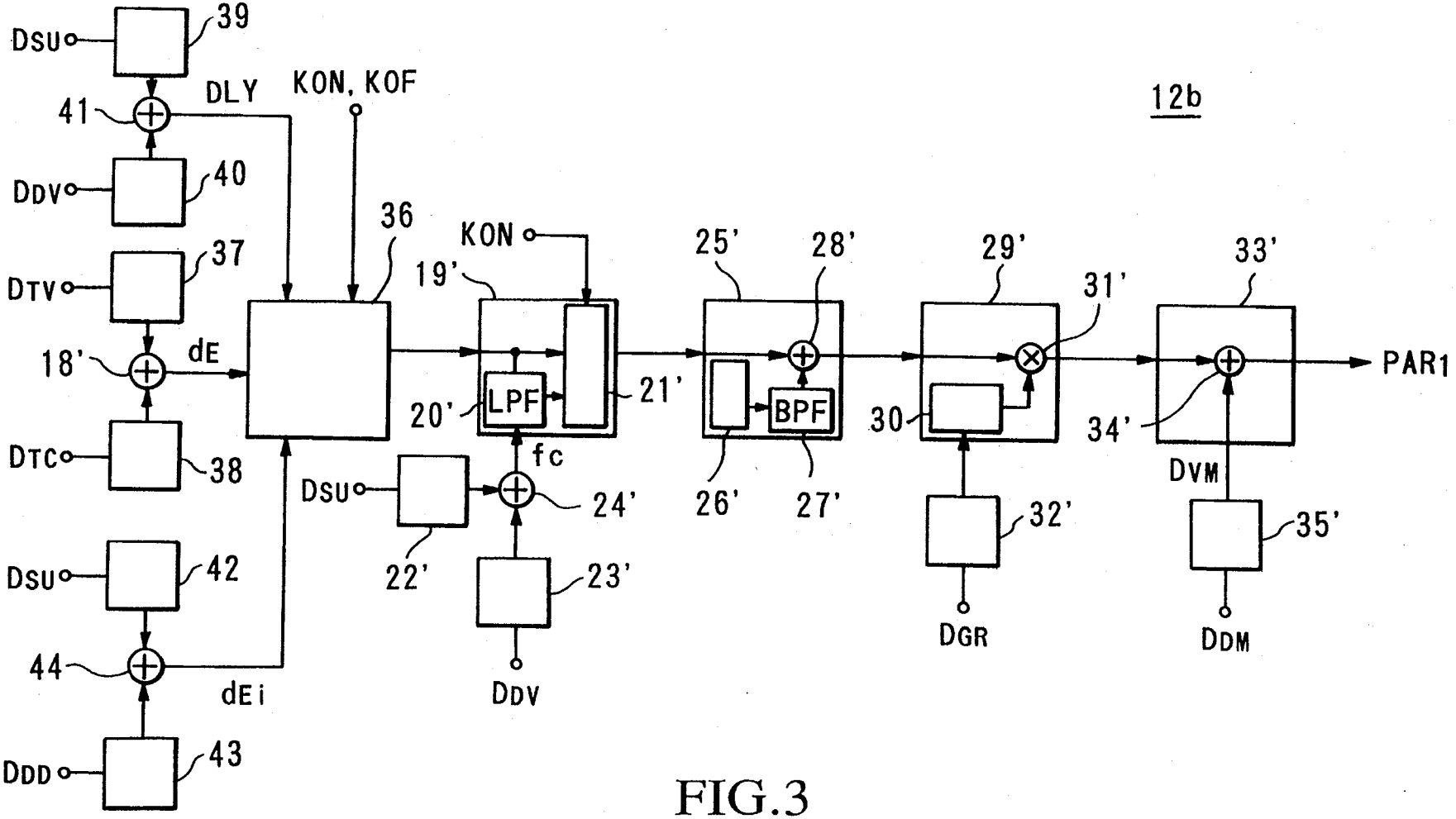
FIG. 3 shows a block diagram of the electrical structure of an embouchure data creating portion 12*b*.
Figure 4:
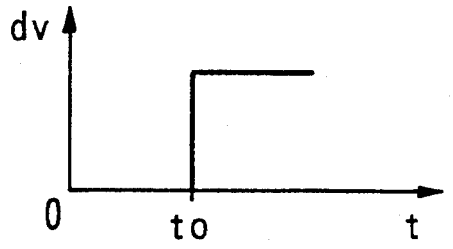
FIG. 4 shows an example of the waveform of the original data of a blowing pressure data VOL.
Figure 10:
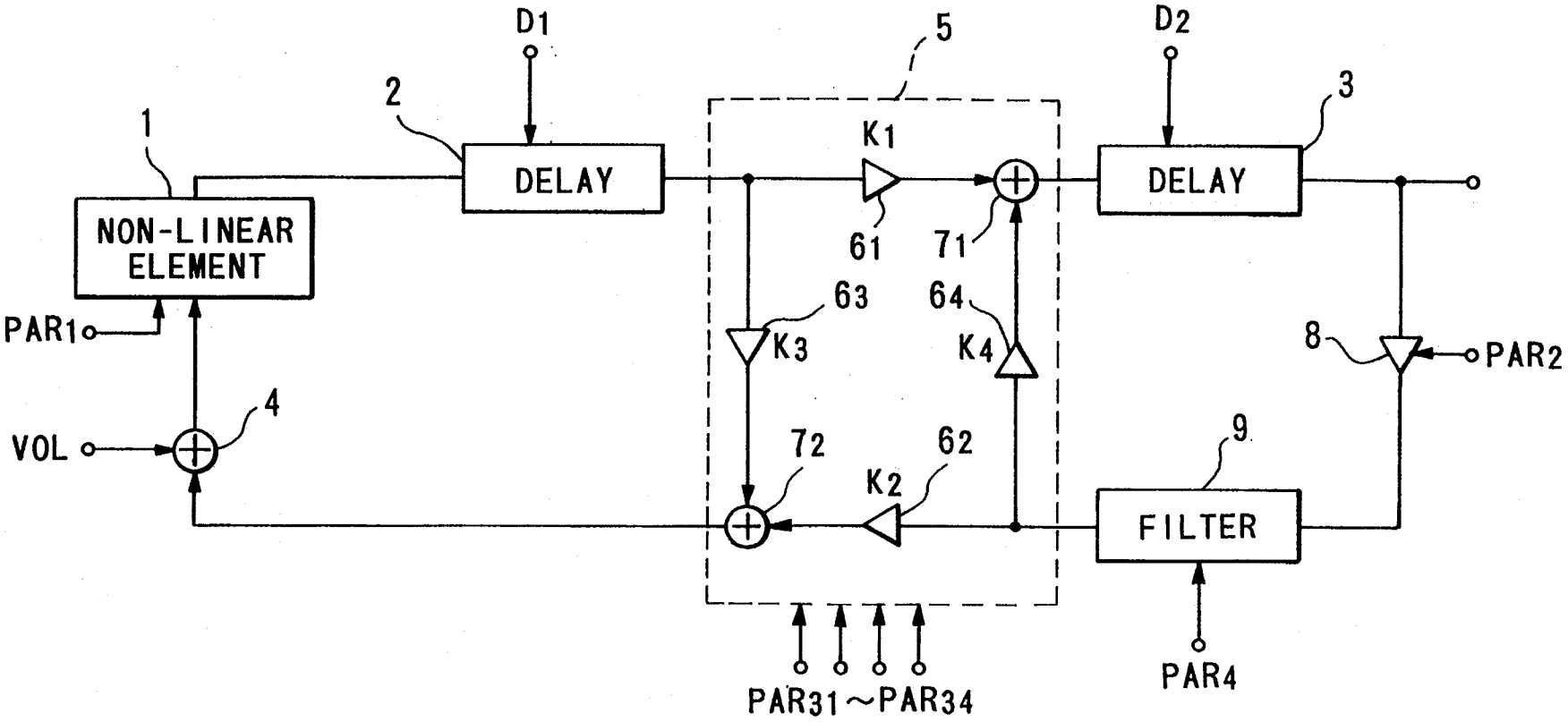
FIG. 10 (PRIOR ART)
FIG. 10 shows a block diagram of an electrical structural example of the conventional physical model tone generating device simulating a wind musical instrument.

Both of FIGS. 2 and 3 show a block diagram of the electrical structure of the parameter creating circuit 12. In this embodiment, since the physical model tone generating device simulating the wind musical instrument shown in FIG. 10 is used as the tone generating circuit 13, the parameter creating circuit 12 comprises a blowing pressure data creating portion **12*a* thereby creating the blowing pressure data VOL shown in FIG. 2, and an embouchure data creating portion 12*b* thereby creating the embouchure data $PAR_1$ shown in FIG. 3. In FIG. 2, an original data creating circuit 15 creates the original data (see FIG. 4) of the blowing pressure data VOL. As shown in FIG. 4**, the original data of the blowing pressure data VOL has a waveform which rises with a step shape at time $t_0$, just when the key-on data is inputted, and then its dynamics (piano, forte, etc.) $d_V$ varies in response to the tone volume data $D_{TV}$ and tone color data $D_{TC}$ described below, and when the key-off data KOF is inputted, the dynamics $d_V$ is damped at the desired rate.

Figure 7A:
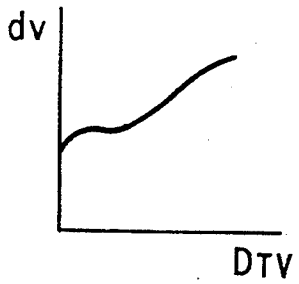
FIG. 7A shows an example of a correlation table 16.
Figure 7B:
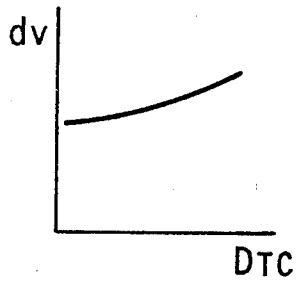
FIG. 7B shows an example of a correlation table 17.

Furthermore, in FIG. 2, a correlation table 16 (see FIG. 7A) stores the correlation between the tone volume data $D_{TV}$, which is one of the musical expression data read out from the automatic performance data memory in the automatic performance data storing/reading out circuit 11, and the dynamics $d_V$ of the blowing pressure data VOL. A correlation table 17 (see FIG. 7B) stores the correlation between the tone color data $D_{TC}$, which is one of the musical expression data read out from the automatic performance data memory in the automatic performance data storing/reading out circuit 11, and the dynamics $d_V$ of the blowing pressure data VOL. An adder 18 adds both of the dynamics $d_V$ respectively read out from the correlation tables 16 and 17. The tone color data $D_{TC}$ relates to fine tone color which is finely varied based on musical instruments with different ranges, or the force of the breathing out or the degree of biting on a mouthpiece while a performer is performing on the same kind of musical instruments.

Figure 7C:
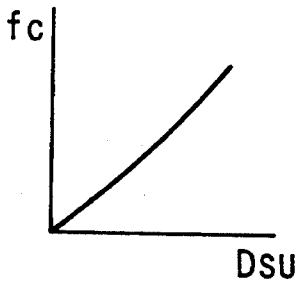
FIG. 7C shows an example of a correlation table 22.
Figure 7D:
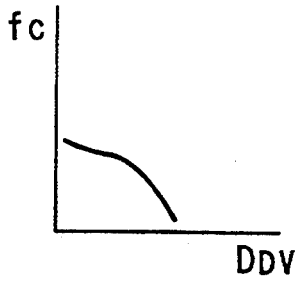
FIG. 7D shows an example of a correlation table 23.

Moreover, an envelope forming circuit 19 comprises a low pass filter (hereinafter referred to as LPF) 20 and a weigher 21, and forms an envelope of the blowing pressure data naturally rising by softening the original data from the original data creating circuit 15. A correlation table 22 (see FIG. 7C) stores the correlation between the rising velocity data $D_{SU}$, which is one of the musical expression data read out from the automatic performance data memory in the automatic performance data storing/reading out circuit 11, and the cut-off frequency $f_C$ of the LPF 20. A correlation table 23 (see FIG. 7D) stores the correlation between the jerking velocity data $D_{DV}$, which is one of the musical expression data read out from the automatic performance data memory in the automatic performance data storing/reading out circuit 11, and the cut-off frequency $f_C$ of the LPF 20. An adder 24 adds both the cut-off frequency $f_C$ respectively read out from the correlation tables 23 and 24. Accordingly, the cut-off frequency $f_C$ of the LPF 20 is controlled by an output data from the adder 24. The above-mentioned jerking is one of the performance methods of the wind musical instrument and signifies that the musical tone rose from a lower tone pitch rather than the required tone pitch, and then rapidly rose to the required tone pitch. Accordingly, the jerking velocity data $D_{DV}$ relates to the velocity when the musical tone is jerked.

Figure 5:
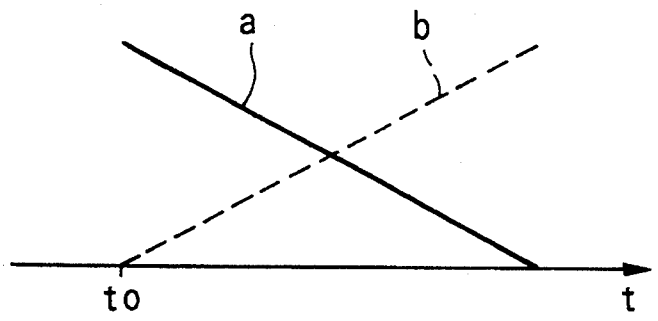
FIG. 5 shows a graph for explaining the operation of a weigher 21.

The weigher 21 cross-fades the original data and the output data from the LPF 20 over time. Namely, immediately after the time $t_0$ when the key-on data is input, the weigher 21 delivers the output data of the LPF 20 at a high rate, as shown with a solid line a in FIG. 5, and delivers the original data at low rate, as shown with a broken line b in FIG. 5, and then gradually decreases the output rate of the output data from the LPF 20 and gradually increases the output rate of the original data over time.

In FIG. 2, a fluctuation imparting circuit 25 imparts natural fluctuation to the blowing pressure and comprises a noise generator 26, a band pass filter (hereinafter referred to as BPF) 27 having the desired band width, and an adder 28. Even if the performer performs the wind musical instrument at constant blowing pressure, since it is natural that some fluctuation generates in the blowing pressure, the fluctuation imparting circuit 25 simulates such a fluctuation.

A growl modulation circuit 29 comprises a rectangle wave generator 30 and a multiplier 31. There is a growl performance method which generates a thick tone, for example, by the shaking of a throat as in one of the performance methods of a wind musical instrument such as a saxophone. The modulation circuit 29 simulates this growl performance method by multiplying the output data from the fluctuation imparting circuit 25 by the rectangle wave, from the rectangle wave generator 30 in the multiplier 31, to finely and rapidly modulate data having a smooth waveform. A correlation table 32 stores the correlation between the growl data $D_{GR}$, which is one of the musical expression data read out from the automatic performance data memory in the automatic performance data storing/reading out circuit 11, and the modulation kind, modulation velocity and modulation depth of the rectangle wave output from the rectangle wave generator 30.

A direct modulation circuit 33 has an adder 34. A correlation table 35 stores the correlation between the direct modulation data $D_{DM}$ such as the modulation kind, modulation velocity and modulation depth of the wave of the modulation data, for example, vibrato which is one of the musical expression data read out from the automatic performance data memory in the automatic performance data storing/reading out circuit 11, and modulation data $D_{VM}$. This direct modulation circuit 33 is provided for imparting a modulation such as vibrato, with a longer period than the growl performance method to the output data from the growl modulation circuit 29. Thus, an output data from the direct modulation circuit 33 is output as a blowing pressure data VOL and supplied to the tone generating device circuit 13.

Next, an explanation of the electrical structure of the embouchure data creating portion **12*b* will be described with reference to FIG. 3. In FIG. 3, the original identifying numeral will be marked with an apostrophe concerning the corresponding components which operate in the same way as the components in the blowing pressure data creating portion 12*a* shown in FIG. 2, and their description will not be repeated. In FIG. 3, an original data creating circuit 36 creates original data (see FIG. 6) of the embouchure data $PAR_1$. A performer usually performs a wind musical instrument using the following performance method. He initially bites a mouthpiece with constant strength until he starts the performance, and then releases the biting on the mouthpiece, to a certain extent the moment he starts the performance, and then bites the mouthpiece again. Accordingly, the original data of the embouchure data $PAR_1$ has the following waveform shown in FIG. 6**. The waveform has a dynamics $d_{EO}$ with the desired level until the time $t_0$ when a key-on data is supplied, and then the dynamics $d_E$ lowers to an initial value $d_{Ei}$ at the time $t_0$ when the key-on data is supplied, rises with a step shape after the required time DLY, then its dynamics $d_E$ varies in response to tone volume data $D_{TV}$ and tone color data $D_{TC}$, and when key-off data KOF is supplied, the dynamics $d_E$ is damped at the desired rate.

Figure 8A:
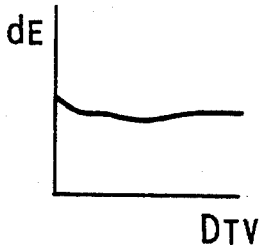
FIG. 8A shows an example of a correlation table 37.
Figure 8B:
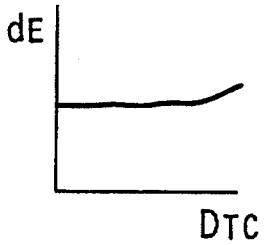
FIG. 8B shows an example of a correlation table 38.
Figure 8C:
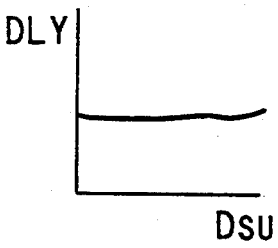
FIG. 8C shows an example of a correlation table 39.
Figure 8D:
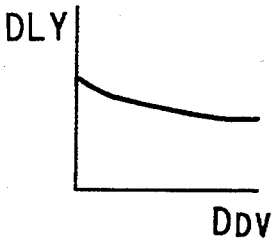
FIG. 8D shows an example of a correlation table 40.

In FIG. 3, a correlation table 37 (see FIG. 8A) stores the correlation between the tone volume data $D_{TV}$ read out from the automatic performance data memory in the automatic performance data storing/reading out circuit 11, and the dynamics $d_E$ of the embouchure data $PAR_1$. A correlation table 38 (see FIG. 8B) stores the correlation between the tone color data $D_{TC}$ read out from the automatic performance data memory, and the dynamics $d_E$ of the embouchure data $PAN_1$. A correlation table 39 (see FIG. 8C) stores the correlation between the rising velocity data $D_{SU}$ read out from the automatic performance data memory in the automatic performance data storing/reading out circuit 11, and the delay DLY of the embouchure data $PAN_1$. A correlation table 40 (see FIG. 8D) stores the correlation between the jerking velocity data $D_{DV}$ read out from the automatic performance data memory in the automatic performance data storing/reading out circuit 11, and the delay DLY of the embouchure data $PAR_1$. An adder 41 adds both of the delays DLY respectively read out from the correlation tables 39 and 40. The delay DLY signifies the time from the time $t_0$ to the time $t_1$.

Figure 6:
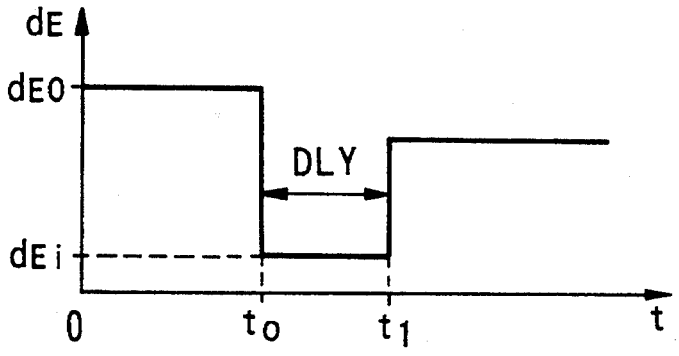
FIG. 6 shows an example of the waveform of the original data of an embouchure data $PAR_1$.
Figure 8E:
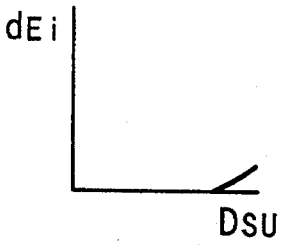
FIG. 8E shows an example of a correlation table 42.
Figure 8F:
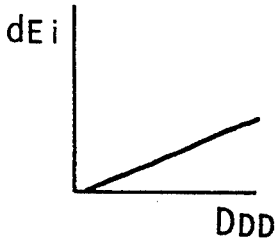
FIG. 8F shows an example of a correlation table 43.

Moreover, in FIG. 3, a correlation table 42 (see FIG. 8E) stores the correlation between the rising velocity data $D_{SU}$ read out from the automatic performance data memory in the automatic performance data storing/reading out circuit 11, and the initial value $d_{Ei}$ of the embouchure data $PAR_1$. A correlation table 43 (see FIG. 8F) stores the correlation between the jerking depth data $D_{DD}$ read out from the automatic performance data memory in the automatic performance data storing/reading out circuit 11, and the initial value $d_{Ei}$ of the embouchure data $PAR_1$. An adder 44 adds both the initial value $d_{Ei}$ respectively read out from the correlation tables 42 and 43. The initial value $d_{Ei}$ is, as shown in FIG. 6, the value of the dynamics $d_E$ lowering at time $t_0$ when the key-on data KON is supplied. The jerking depth data $D_{DD}$ is the data which signifies from how deep, that is, from how low the tone pitch musical tone is rose in the above-mentioned jerking performance method.

Figure 9:
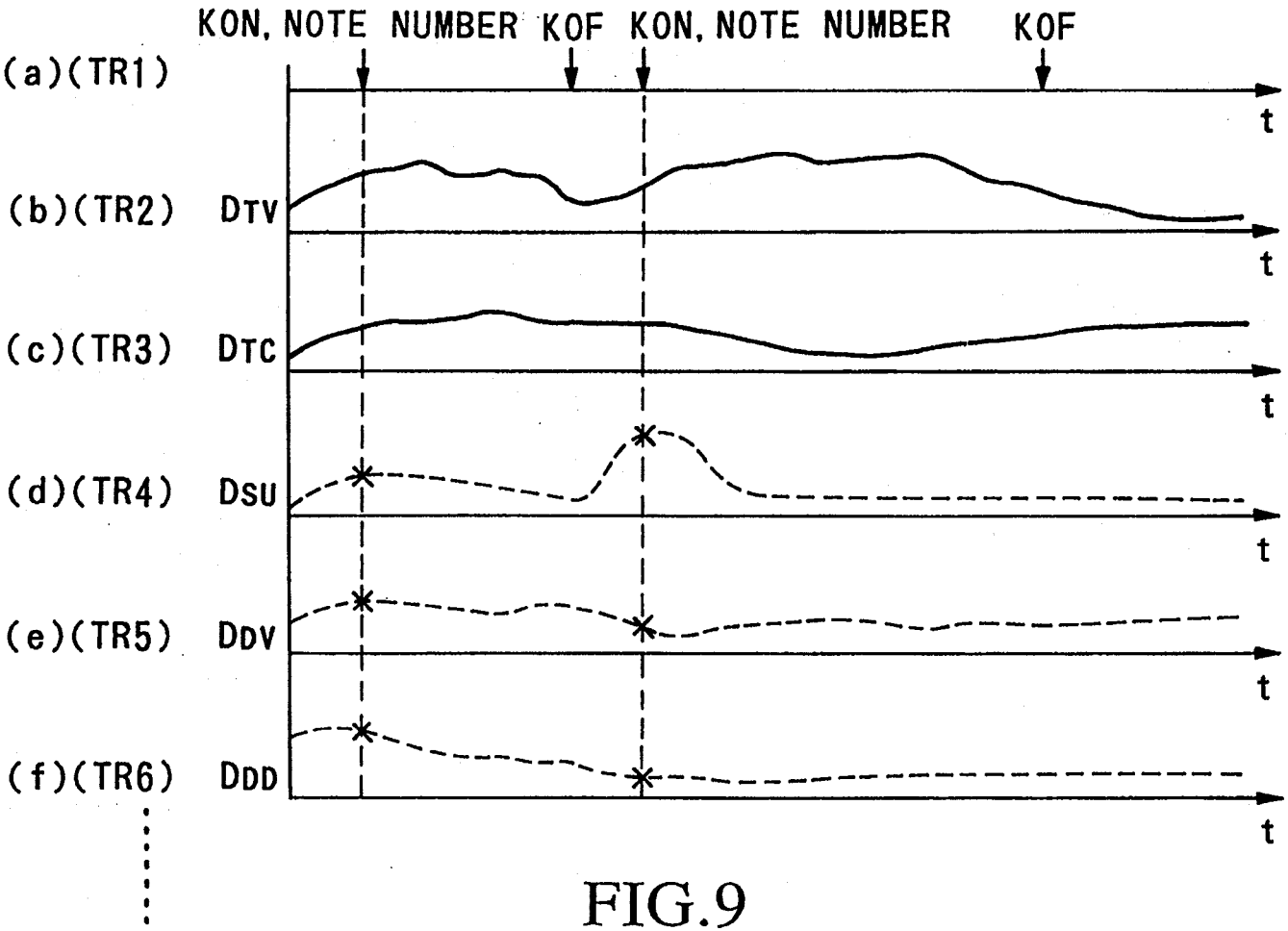
FIG. 9 shows a timing chart for explaining the technique for storing each data in each track of an automatic performance data memory.

Next, an explanation of the technique which stores data in each of the tracks of the automatic performance data memory in the automatic performance data storing/reading out circuit 11 will be described with reference to FIG. 9. In the automatic performance data memory, as shown in FIG. 9, a track TR1 for storing basic performance data, tracks TR2 through TR6 for storing the corresponding musical expression data, are provided. Each of the data is stored in the form of an event and timing data in the corresponding track TR.

Initially, only key-on data, note number and key-off data KOF, which are the basic performance data and to which the musical expression are not imparted, are successively stored in the track TR1 in response to the performance operation of the manually operable performance member in the input apparatus 10. Previous data in track TR1 are invalid at the point when the key-on data is supplied, and then the dynamics $d_V$ of the blowing pressure data VOL immediately rises with a step shape, and the dynamics $d_E$ of the embouchure data $PAR_1$ immediately lowers to the initial value $d_{Ei}$. Next, the musical expression data corresponding to the above-mentioned basic performance data are stored in each of tracks TR2 through TR6, however the storing order is changeable. In an example shown in FIG. 9, the tone volume data $D_{TV}$ is stored in the track TR2, the tone color data $D_{TC}$ is stored in the track TR3, the rising velocity data $D_{SU}$ is stored in the track TR4, the jerking velocity data $D_{DV}$ is stored in the track TR5, and the jerking depth data $D_{DD}$ is stored in the track TR6. The input of these data may be carried out using the manually operable member which is easy for the performer to use. For example, the tone volume data $D_{TV}$ is input using the pedal or the tone color data $D_{TC}$ is input using the wheel. In this case, the performer can sensitively store each of the musical expression data in each of the tracks TR2 through TR6. For example, the tone color is set at a cheerful tone, or the rising of the musical tone is set sharply. The tone volume data $D_{TV}$ and tone color data $D_{TC}$ must be successively stored in the corresponding tracks TR in the same way as the basic performance data, however because the rising velocity data $D_{SU}$, the jerking velocity data $D_{DV}$, and the jerking depth data $D_{DD}$, and the like are needed only when the key-on KON is input. With regard to these data, that is data where the output data of each of the manually operable members are shown with a broken line in FIG. 9, they are sampled at the timing of the key-ons, and are stored in each of the tracks TR as marked with a "x" in (d) through (f) of FIG. 9.

In the case where these data are edited after each of the data is once stored in the corresponding track TR using the above-mentioned technique, the operator can sensitively edit these data with any editing method, for example, which changes separately these data, or which changes many data all together, or which does not change the data in all of the performance time, but change the data in only a certain interval of the performance time. The data stored separately in a plurality of tracks TR may be also mixed, and the mixed data may be stored in one of the tracks TR. In this case, however, it is necessary to form each of the data, for example in the form of "class, value, generating timing", so that each of the data can be distinguished from one another.

Next, in order to carry out the automatic performance after each of the data is thus stored in each of the tracks TR of the automatic performance data memory in the automatic performance data storing/reading out circuit 11, the stored basic performance data and musical expression data in each of the tracks TR of the automatic performance data memory, in the automatic performance data storing/reading out circuit 11, are read out according to the progress of a musical piece in due order and delivered to the parameter creating circuit 12. The note number among the basic performance data are supplied to the tone generating device circuit 13. The delay data $D_1$ and $D_2$ are created based on the supplied note number in the tone generating device circuit 13. Therefore, the parameter such as the blowing pressure data VOL and embouchure data $PAR_1$ are created based on the basic performance data and musical expression data read out by the automatic performance data storing/reading out circuit 11 in the parameter creating circuit 12 and the created parameters are supplied to the tone generating device circuit 13. In the tone generating device circuit 13, a musical tone data is formed based on the supplied parameters from the parameter creating circuit 12 and the supplied note number from the automatic performance data storing/reading out circuit 11, and delivers it. Accordingly, in the sound system 14, the supplied musical tone data from the tone generating device circuit 13 is converted into an analog musical signal in a D/A converter, the musical tone signal is amplified in an amplifier, and then the musical tone is output form speakers.

As described above, according to the above-mentioned preferred embodiment, even if there are of a variety of the musical expression data to be inputted, since a plurality of the musical expression data may be individually inputted, it is not necessary for the operator to operate many manually operable members all together. Accordingly, the operator can easily operate the manually operable members.

Furthermore, in the above-mentioned preferred embodiment, the example is given in which, the physical model tone generating device simulating the wind musical instrument is used as the tone generating device circuit 13; however, the present invention is not limited thereto. For example, the physical model tone generating device simulating the rubbed stringed musical instrument is used as the tone generating device circuit 13. In this case, there are bow pressure data or bow velocity data and the like as the parameters. Not only the physical model tone generating device but also a FM (Frequency Modulation) tone generating device or a PCM (Pulse Code Modulation) tone generating device may be used as the tone generating device circuit 13. In the case of the FM tone generating device, the same as the physical model tone generating device, because the relation between a parameter and the generation of a musical tone is complex, the generation of those parameters proceeds in the same way as the above-mentioned preferred embodiment, and thereby the same effect can be obtained. In contrast, in the case of the PCM tone generating device, the operation may be carried out so that the corresponding waveform data are automatically selected by changing the musical expression data.

Furthermore, in the above-mentioned preferred embodiment, the example is given in which, the parameter creating circuit 12 comprises the blowing pressure data creating portion **12*a* shown in FIG. 2 and the embouchure data creating portion 12*b* shown in FIG. 3; however, the present invention is not limited thereto. In addition, in the above-mentioned preferred embodiment, the example is given in which, the parameter creating circuit 12** creates only the blowing pressure data VOL and the embouchure data $PAR_1$; however, the present invention is not limited thereto. It is natural to create the other parameter, namely, the delay data $D_1$ and $D_2$, the multiply data $PAR_{31}$ through $PAR_{34}$, the multiply data $PAR_2$, and the coefficient data $PAR_4$ using the same technique as the above-mentioned technique. It is needless to say that the musical expression data are not limited to those of the above-mentioned preferred embodiment.

Furthermore, in the above-mentioned preferred embodiment, the example is given in which, the automatic performance is carried out after data are stored in all of the tracks TR of the automatic performance data memory in the automatic performance data storing/reading out circuit 11; however, the present invention is not limited thereto. For example, only the basic performance data is stored in the track TR1 and the musical expression data may be stored in the corresponding track TR of the automatic performance data memory in due order while automatic performing is using only the basic performance data. In this case, even an operator which is weak in the operation can scrupulously impart sound expression to musical tone by lowering the speed of the automatic performance. Moreover, in the case of storing the basic performance data, only the note number may be earlier stored than the key-on data or the key-off data KOF. The technique which automatic performance data are in a plurality of track of an automatic performance data memory has been disclosed in U.S. Pat. No. 4,930,390.

What is claimed is:

1. An automatic performance apparatus comprising:

storage means for storing basic performance data corresponding to the basic performance of a musical piece and musical expression data corresponding to musical expression, which is imparted to said basic performance, according to the progress of said musical piece;

reading out means for reading out said basic performance data and said musical expression data from said storage means in due order;

parameter creating means for creating parameters including said musical expression based on the read out basic performance data and musical expression data; and musical tone forming means for receiving said created parameters and forming musical tone signals, to which said musical expression is imparted, based on the received parameters.

2. An automatic performance apparatus according to claim 1 wherein said basic performance data has data indicating the tone pitches and tone generation timings of musical notes in said musical piece.

3. An automatic performance apparatus according to claim 1 wherein said musical expression data has data indicating the tone volume of a musical tone varying over time.

4. An automatic performance apparatus according to claim 1 wherein said musical expression data has data indicating the tone color of a musical tone varying over time.

5. An automatic performance apparatus according to claim 1 wherein said musical expression data has data indicating a performance method of a non-electronic musical instrument.

6. An automatic performance apparatus according to claim 1 wherein said musical expression data includes a plurality of musical expression data different from each other, and said storage means has a plurality of storage tracks in which said plurality of musical expression data are stored, respectively.

7. An automatic performance apparatus according to claim 6 further comprising a plurality of manually operable members corresponding to the plurality of musical expression data, wherein the plurality of musical expression data are respectively generated in response to the operations of the manually operable members, and the plurality of generated musical expression data are respectively stored in the corresponding storage tracks.

8. An automatic performance apparatus according to claim 1 wherein said musical tone forming means simulates the sound production mechanism of the a wind musical instrument, and said parameter creating means has a first portion creating a blowing pressure parameter and a second portion creating an embouchure parameter.

9. An automatic performance apparatus according to claim 1 further comprising editing means for editing said musical expression data.

10. An automatic performance apparatus comprising:

storage means having a plurality of storage tracks;

a plurality of manually operable members each of which generates operation information in response to the operation thereof by a player and corresponds to one of said plurality of storage tracks;

writing means for writing the generated operation information in the corresponding one of said plurality of storage tracks;

reading out means for reading out said operation information from each of said plurality of storage tracks; and creating means for creating at least one musical tone control parameter based on the read out operation information from each of said plurality of storage tracks, wherein an automatic performance is carried out based on said created one musical tone control parameter.

11. An automatic performance apparatus according to claim 10 wherein said operation information generated by each of said plurality of manually operable members is successively stored in the corresponding storage track of said storage means over time.

12. An automatic performance apparatus according to claim 10 wherein said operation information generated by each of said plurality of manually operable member are intermittently stored, together with operation-timing information corresponding thereto, in the corresponding storage track of said storage means.

13. An automatic performance apparatus according to claim 10 wherein said operation information comprises basic performance data corresponding to the basic performance of a musical piece and musical expression data corresponding to musical expression.

14. An automatic performance apparatus comprising:

storage means having a plurality of storage tracks;

a plurality of manually operable members each of which generates operation information in response to the operation thereof by a player and corresponds to one of said plurality of storage tracks wherein the operation information comprises data corresponding to musical expression data which is imparted to a basic performance;

writing means for writing the generated operation information in the corresponding one of said plurality of storage tracks;

reading out means for reading out said operation information from each of said plurality of storage tracks; and creating means for creating at least one musical tone control parameter based on the read out operation information from each of said plurality of storage tracks, wherein an automatic performance is carried out based on said created one musical tone control parameter.

* * * * *